United States Patent [19]

Ohba et al.

[11] Patent Number: 4,545,866

[45] Date of Patent: Oct. 8, 1985

[54] PROCESS FOR PRODUCING SUPPORT FOR PLANOGRAPHIC PRINTING

[75] Inventors: Hisao Ohba; Akira Shirai; Etsuo Kitazumi; Norihiko Kato, all of Shizuoka, Japan

[73] Assignee: Fuji Photo Film Co., Ltd., Kanagawa, Japan

[21] Appl. No.: 632,148

[22] Filed: Jul. 18, 1984

[30] Foreign Application Priority Data

Jul. 18, 1983 [JP] Japan ..... 58-130440

[51] Int. Cl.[4] ..... C25D 5/44; C25F 3/04

[52] U.S. Cl. ..... 204/33; 204/129.43; 204/129.75

[58] Field of Search ..... 204/129.75, 129.4, 129.43, 204/33

[56] References Cited

U.S. PATENT DOCUMENTS

| | | | |
|---|---|---|---|
| 1,376,366 | 4/1921 | Wertheimer | 204/129.75 |
| 3,935,080 | 1/1976 | Gumbinner | 204/129.75 |
| 4,427,506 | 1/1984 | Nguyen | 204/129.75 |

FOREIGN PATENT DOCUMENTS

| | | | |
|---|---|---|---|
| 40-29003 | 12/1965 | Japan | 204/129.75 |

*Primary Examiner*—Thomas Tufariello

*Attorney, Agent, or Firm*—Sughrue, Mion, Zinn, Macpeak & Seas

[57] ABSTRACT

A process for producing a support for planographic printing is described, which comprises electrochemically graining the surface of an aluminum plate with an electrolytic solution containing from 1,000 to 40,000 ppm of nitric acid, from 50 to 4,000 ppm of sulfuric acid group.

11 Claims, 14 Drawing Figures

10μ

10μ

10μ

10μ

10μ

10μ

10μ

10μ

10μ

10μ

PROCESS FOR PRODUCING SUPPORT FOR PLANOGRAPHIC PRINTING

FIELD OF THE INVENTION

The present invention relates to supports and a process for producing the same, and particularly to grained aluminium plates for planographic printing and a process for producing the same.

BACKGROUND OF THE INVENTION

Hitherto, aluminium plates have been widely used as supports for planographic printing. The surface of aluminium plates is ordinarily grained for the purpose of improving an adhesive property to the light-sensitive layer provided thereon, and of improving a water retentive property of nonimage parts (areas where the surface of the support is exposed, which receive dampening water used for printing, and which repels oily inks) of planographic printing plates produced with them. This graining processing is called graining, and is an essential step for preparation of a support for planographic printing. The graining processes known include mechanical graining processes such as ball graining, wire graining, brush graining, blast graining, etc., electrolytic graining processes which comprise carrying out electrochemical etching in an acid or neutral aqueous solution, and chemical graining processes which comprise chemically etching with acid or alkali using specific aluminium alloy materials. In *Heiban Seihan Insatsu no Kiso,* published by Insatsu Jiho Co., pages 35–37, by Kenichi Sugiyama, Dec. 1, 1965, a general explanation of graining processes is described, and a process which comprises carrying out mechanical graining with using an abrasive slurry is specifically described. In *Insatsu Zasshi* (Japan Printer), July 1963, pages 2–4 in an article entitled "General Statement of Alumite Planographic Plate", by Sano, a process for producing planographic printing plates which comprises electrolytically graining by an alternating electric current in a hydrochloric acid or nitric acid solution, and thereafter carrying out anodic oxidation, is described. Japanese Patent Publication No. 42284/79 discloses a process for producing planographic printing plates wherein an aluminium plate containing from 1.6 to 2.5% of manganese is subjected to chemical graining with alkali.

Complex graining processes suitably combining these known graining processes are also known. For example, U.S. Pat. No. 2,344,510 discloses a process for producing a support for planographic printing which comprises carrying out mechanical graining and then electrochemical graining with hydrochloric acid etc., to form superimposed complex grains on the surface, and thereafter carrying out anodic oxidation. Japanese Patent Publication No. 16918/82 and British Patent B.P. No. 2,047,274 have disclosed a process for producing a support for planographic printing which comprises carrying out mechanical graining, chemical etching with acid or alkali and electrochemical etching in turn, and thereafter carrying out anodic oxidation. Further, British Pat. No. 2,118,575 discloses a process for producing a support for planographic printing which comprises carrying out mechanical graining, chemical etching and electrochemical graining in an acid electrolytic solution by an alternating wave-form electric current to form a grain structure consisting of plateaus and pits on the aluminium surface.

It has been found that the shape of fine unevenness observed in the case of magnifying the surface of the grained aluminium support from 2000 to 5000 times has the following very great influences upon printing performance when used as a support for planographic printing:

(1) It causes firm adhesion between the image layer and the support to improve printing durability;

(2) It causes firm adhesion to the support throughout the development step for fine halftone images of from 1 to 5% or so to the printing step to improve tone reproduction;

(3) It causes firm adhesion of a hydrophilic coating layer (for example, gum arabic) to the nonimage parts to improve hydrophilic property; and (4) It causes improvement of the water retentive properties of the nonimage parts.

As a result of observation and extensive studies with respect to this fine unevenness structure, the following has been discovered.

(a) Generally, the grained surface has a coarse structure (primary structure) and a fine structure (secondary structure), and fine unevenness having the above described effects originates in the secondary structure.

(b) In carrying out mechanical graining, it is possible to control the secondary structure by selecting granularity of the abrasive used and by carefully determining processing conditions.

This plan has been disclosed in Japanese Patent Publication Nos. 42282/79 and 42283/79, as a process for producing aluminium printing plates for offset which comprises carrying out mechanical graining with two kinds of abrasives, each having a different grain size, by a wet blast method (liquid honing method).

However, since abrasives and cutting dusts of aluminium, etc., remain on the mechanically grained surface, there are generally problems of blackening of external appearance and contamination during printing caused by these residual materials, especially in case of producing a printing plate by carrying out anodic oxidation.

(c) In order to solve the above described problems, it is effective to use a process which comprises carrying out chemical etching with acid or alkali, as described in U.S. Pat. No. 3,834,998 or a process which comprises carrying out electrochemical etching in phosphoric acid and thereafter carrying out anodic oxidation as described in U.S. Pat. No. 3,929,591. However, a new problem thereby arises, namely, the surface character obtained by graining deteriorates, resulting in deterioration of water retention and printing durability, because the secondary structure tends to disappear in the etching step.

(d) In the case of electrochemical graining, formation of superimposed structure is similarly observed. For example, a report supporting this fact can be found in *Sumitomo Light Metal Giho,* Vol. 15, No. 2, April 1974, in an article entitled "Process for the Production of Electrolytically Etched and Anodized Strip".

According to the research of the present inventors, a quantity of electricity of from 1000 to 1500 coulombs/dm$^2$ is required for obtaining an average surface roughness (Ra=0.6) of PS plates (Presensitized plate) conventionally available in the market by graining in an electrolytic solution containing hydrochloric acid as a main component by a commercial alternating electric current. Since the whole surface just after electrolysis is covered with insoluble residues, called smut, which are generally difficult to remove by washing with water or cleaning by a brush, the surface is necessarily etched with alkali, as described in Japanese Patent Publication No. 28123/73. As the result, though the secondary structure is present on the surface which is carefully subjected to slight etching, it disappears when the etching even slightly exceeds an optimum extent, and, consequently, there is a fault that water retention and hydrophilic property deteriorate similarly to (c).

(e) Many attempts of adding various additives to the hydrochloric acid, by which formation of coarse primary structure is prevented to accelerate formation of a fine secondary structure, have been proposed. It has been known hitherto to add additives, for example, additives such as nitric acid, chromic acid or hydrofluoric acid (Japanese Patent Publication No. 28123/73), additives such as amines, aldehydes or nonionic surfactants (U.S. Pat. No. 3,755,116), boric acid (French Pat. No. 2,110,257 and U.S. Pat. No. 3,980,539) and phosphoric acid (U.S. Pat. No. 3,887,447), etc.

Particularly, in U.S. Pat. No. 3,887,447, it has been described that a factor obstructing uniform formation of fine pits is sulfuric ion present in the electrolytic solution as impurities in a very small amount, and that uneven coarse pits are formed when from 10 to 15 ppm of sulfuric acid ion are present, and it has been proposed to add phosphoric acid in order to improve it.

(f) The present inventors have gained confidence that an electrolytic solution containing nitric acid as a main component is advantageous for forming uniformly and effectively a fine secondary structure on the surface, as compared with hydrochloric acid. This reason is that the amount of smut on the surface which is electrolytically grained with an electrolytic solution containing nitric acid as a main component is smaller than that in case of using hydrochloric acid and, therefore, the smut can be removed by comparatively mild post-processing. Thus, it has an advantage that grains obtained by electrolytic graining are hardly destroyed.

However, since a grain structure obtained with an electrolytic solution containing only nitric acid by a commercial electric current has an irregular uneven state containing huge pits, there is a fault that a uniform surface structure having a desired surface roughness necessary for the printing plate can not be obtained.

(g) Further, Japanese Patent Publication No. 764/65 has disclosed a process for forming a fine grain structure which comprises adding protective colloid containing lignin as a main component, aromatic aldehyde or aromatic ketone to nitric acid.

However, according to results of examinations by the present inventors, the effect thereof is still insufficient to completely attain the desired results.

SUMMARY OF THE INVENTION

As a result of further extensive studies, the present inventors have found that the above described subjects can be attained when a very limitative range of sulfate ion is allowed to coexist in an electrolytic solution containing nitric acid as a main component. Considering the description in U.S. Pat. No. 3,887,447 that coexistence of sulfuric acid ion has an adverse influence, such a fact is very surprising.

The present invention thus is directed to a process for producing a support for planographic printing which comprises electrochemically graining the surface of an aluminum plate with an electrolytic solution containing from 1,000 to 40,000 ppm of nitric acid, from 50 to 4,000 ppm of sulfate ion.

DETAILED DESCRIPTION OF THE INVENTION

According to the present invention, a pit structure having desirable characteristics in shape can be obtained, as illustrated in detail in the following, and these characteristics in shape produce a very suitable effect on printing performance (e.g., printing durability, resistance to background contamination).

(1) Pits obtained by the present process have a circular independent structure having an opening diameter of from 0.3 to 8 microns.

(2) When electrochemical graining is carried out according to the present process using an alternating wave form electric current in a ratio of quantity of cathode time electricity to quantity of anode time electricity of from 0.4/1 to 1.25/1, a uniform grained surface wherein huge pits are not maldistributed can be obtained, and uniform graining can be carried out at quantity of electricity of 2,000 coulombs/dm$^2$ to result in surface roughness of about 0.8 microns. In the way, in case of using nitric acid alone, an irregular grained surface wherein huge pits are maldistributed starts to form at about 500 coulombs/dm$^2$, and it is difficult to produce a uniform grained structure having a surface roughness of 0.5 microns or more.

(3) A grained surface having a superimposed structure which is obtained by distributing a pit structure described in (1) as the secondary structure on a grained surface which is previously grained mechanically and/or chemically so as to have a desired surface roughness, according to the present process using an alternating wave form electric current at a quantity of anode time electricity of not exceeding 2,000 coulombs and a voltage thereof of from 5 to 50 V, a current density of from 10 to 100 A/dm$^2$ and a ratio of quantity of cathode time electricity/quantity of anode time electricity of from 0.4/1 to 1.25/1 shows the most excellent result in printing properties. Details thereof are illustrated in the examples which follow.

Figure 1:
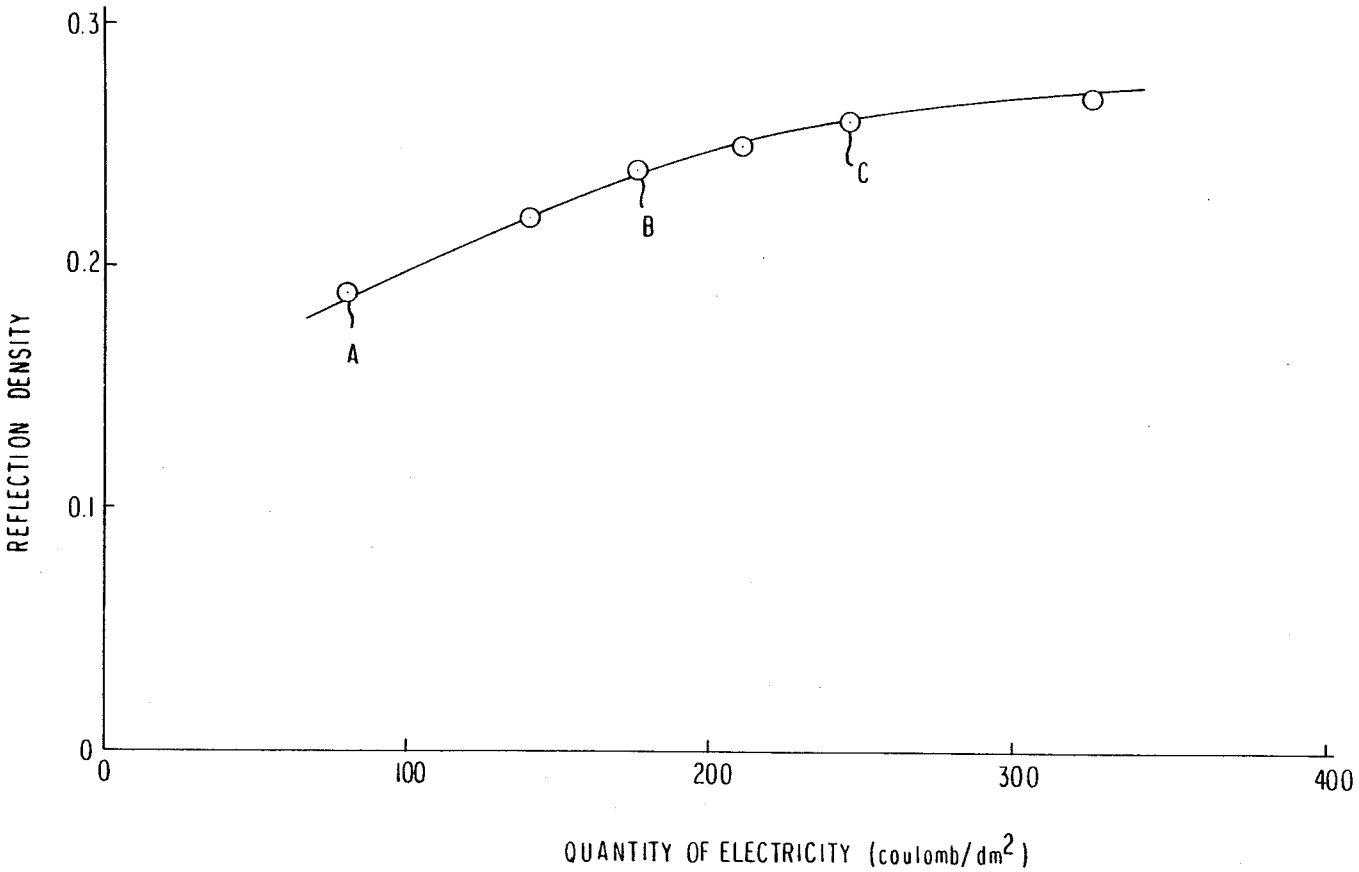
FIG. 1 is a graph indicating the relation between quantity of electricity and reflection density of the grained aluminum surface obtained using a nitric acid electrolytic solution.
Figure 2:
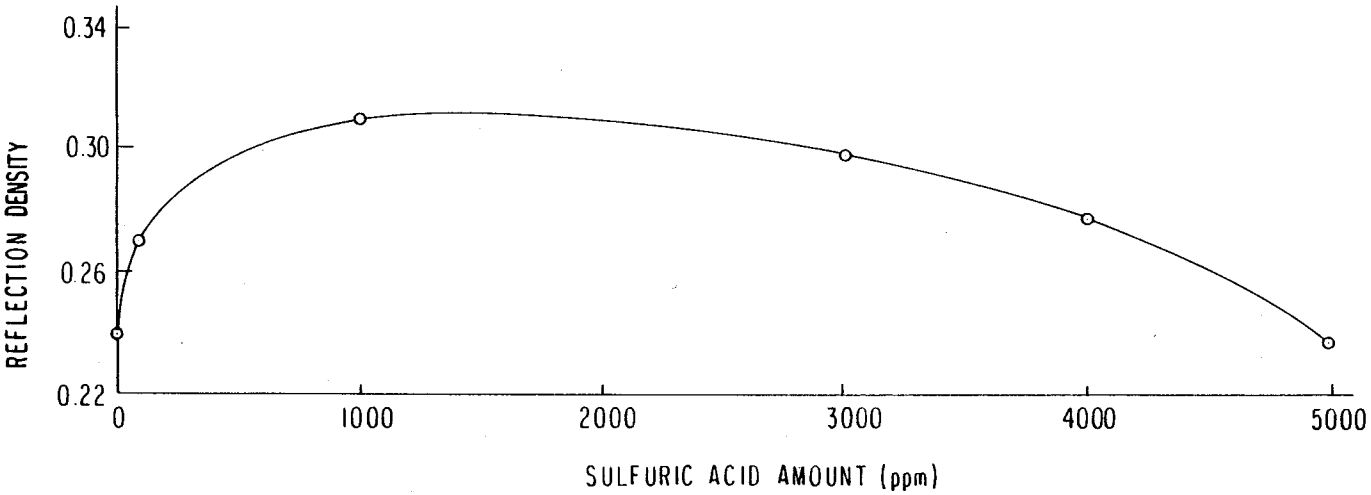
FIG. 2 is a graph indicating a change of reflection density in the case of varying the amount of sulfuric acid added with keeping quantity of electricity at a constant value.
Figure 5A:
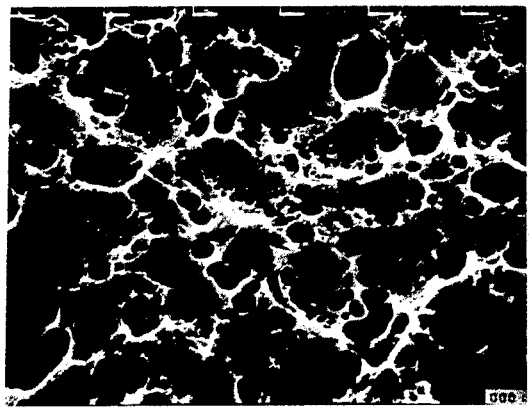
FIG. 5A, FIG. 5B and FIG. 5C are electron microphotographs of samples obtained by varying the quantity of electricity using an nitric acid electrolytic solution.
Figure 5B:
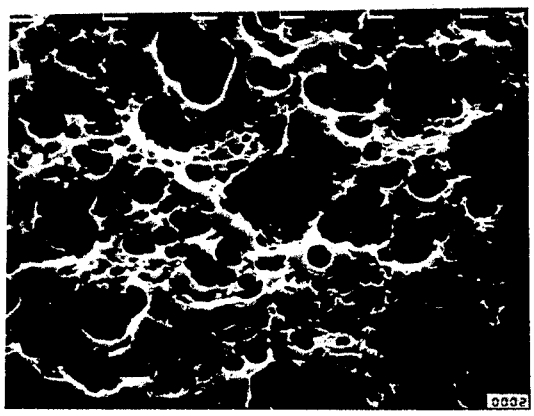
Figure 5C:
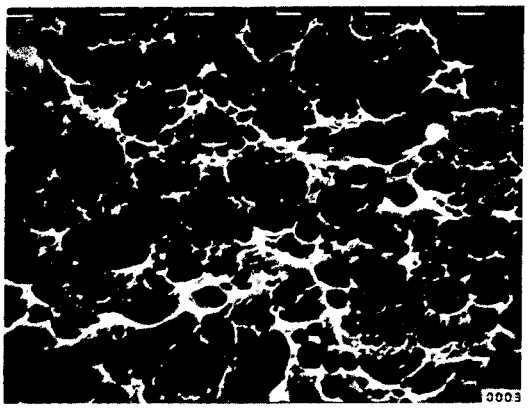

(4) Another special effect in the above (3) is that the superimposition density of the pit structure can be controlled by varying the concentration of sulfate ion added, which is an unexpected surprising matter. FIG. 1 shows a result of carrying out electrolytic graining with an alternating wave form electric current (quantity of cathode time electricity/quantity of anode time electricity: 0.8/1) using an electrolytic solution containing only nitric acid (concentration of nitric acid: 7 g/l). In FIG. 1, the abscissa shows the quantity of electricity applied (quantity of anode time electricity: coulombs/$dm^2$) and the ordinate shows reflection density of a grained aluminium surface obtained. FIG. 5A, FIG. 5B, and FIG. 5C are scanning type electron microphotographs (hereinafter referred to as SEMs) of the surface of each sample, which are magnified 1,500 times. It is understood from FIG. 1, FIG. 5A, FIG. 5B, and FIG. 5C that the density of pits having an opening diameter of 0.3 to 8 microns increases in proportion to the quantity of electricity, and the reflection density of the grained surface increases therewith. FIG. 2 is a graph indicating a relation between the amount of sulfuric acid added to nitric acid and reflection density under a certain quantity of electricity as an example, wherein the abscissa indicates the amount of sulfuric acid added (unit: ppm) and the ordinate indicates reflection density of the grained aluminium surface obtained. In this case, electrochemical graining is carried out under the following conditions: concentration of nitric acid—7 g/l; quantity of anode time electricity—175 coulombs/$dm^2$; quantity of cathode time electricity—145 coulombs/$dm^2$; and quantity of cathode time electricity/quantity of anode time electricity —0.8/1. FIG. 6A, FIG. 6B, FIG. 6C and FIG. 6D are SEMs of grained surfaces corresponding to a concentration of sulfuric acid of 0 ppm, 10 ppm, 1,000 ppm and 5,000 ppm, respectively. It is understood therefrom that the density of fine pits increases when the concentration of sulfuric acid is in a specific range, even though the same quantity of electricity is used. The same results can be obtained in the case of varying the quantity of electricity applied, also. A useful concentration of sulfate ion depends upon the concentration of nitric acid, current density of alternating wave form electric current and amount of aluminum nitrate coexistent, but it is in a range of 50 to 4,000 ppm. If it exceeds 5,000 ppm, the etching reaction is prevented by formation of a passive film. Since the concentration of sulfuric acid ion present in well water is generally in a range of from 2 to 25 ppm, it is difficult to control it. As sources of the above described sulfate ion, it is possible to use an alkali metal salt of sulfuric acid, such as the potassium salt and sodium salt of sulfuric acid, in addition to sulfuric acid. Of these, sulfuric acid is preferable.

Nitric acid can be used in a range of from 1,000 to 40,000 ppm, preferably 5,000 to 30,000 ppm.

As coexistent components, there are Al, $CO_3^{2-}$, Na, Fe and Si. The coexistent components, however, are customary and non-interferring components. With respect to aluminum, aluminum nitrate can be used in a range of from 1,000 to 20,000 ppm.

(5) As shown in FIG. 2, behavior in the case of adding sulfuric acid to nitric acid can be classified roughly into three categories. In the range of from 0 to 800 ppm, the pit density increases with increases in the amount added. In the range of from 800 to 3,000 ppm, the pit density remains constant. In the range of from 3,000 ppm to 4,000 ppm, the effect gradually decreases with increases in the amount added. Accordingly, in the first range, it is possible to save on the quantity of electricity applied by controlling the concentration of sulfate ion. Further, in the second range insensible to the concentration of sulfate ion, printing plates having excellent printing performances can be produced under a wide tolerance of production conditions, because surfaces having the above described characteristics (1) to (3) can be obtained.

Examples of aluminum plates that can be used in the present invention include pure aluminum plates and aluminum alloy plates. As aluminum alloys, various kinds of alloys can be used. For example, alloys composed of aluminum and metals such as silicon, copper, manganese, magnesium, chromium, zinc, lead, bismuth, nickel, etc., can be used. Examples of aluminum alloys are shown in the following table. In the table, the unit of numerals is the % by weight, and the balance is aluminum.

| Aluminum alloy | Si | Cu | Mn | Mg | Cr | Zn |
|---|---|---|---|---|---|---|
| 2S | 0.4 | — | — | 0.6 | — | — |
| 3S | — | — | 1.2 | — | — | — |
| 24S | — | 4.5 | 0.6 | 1.5 | — | — |
| 52S | — | — | — | 2.5 | 0.25 | — |
| 61S | 0.6 | 0.25 | — | 1.0 | 0.25 | — |
| 75S | — | 1.60 | — | 2.50 | 0.30 | 5.60 |

These compositions contain negligible amounts of other impurities in addition to small amounts of iron and titanium.

In a preferred embodiment of the present invention, the aluminum plate is first mechanically grained. Prior to this processing, it is generally desired to carry out preliminary processing in order to remove rolling oils from the surface of the aluminum and thus expose a cleansed surface of aluminum. In order to remove rolling oils, processing with a solvent such as trichloroethylene, etc., or a surfactant is carried out. In order to obtain a cleansed surface, a process for etching with an aqueous alkali solution such as sodium hydroxide, potassium hydroxide, etc., is widely used.

However, in the present invention, the previous processing prior to mechanical graining can be omitted unless a very large amount of rolling oil is adhered to the surface.

In the process of the present invention, any of the above described processes for mechanical graining may be used.

The mechanically grained aluminum plate is then chemically etched. This processing is carried out in order to remove abrasives and aluminum dust intruding into the aluminum in case of mechanical graining so that the subsequent electrochemical graining can be effectively carried out, and it is generally carried out by immersing the aluminum plate in an aqueous solution of acid or alkali.

As examples of the aqueous solution of acid or alkali, aqueous solutions of acids, such as hydrofluoric acid, fluorozirconic acid, phosphoric acid, sulfuric acid, hydrochloric acid or nitric acid, etc., or alkali such as sodium hydroxide, potassium hydroxide, sodium tertiary phosphate, sodium aluminate, sodium silicate or sodium carbonate, etc., can be used. In these aqueous solution of acid or alkali, one or more kinds of acids or alkalis can be used alone or as a mixture.

The etching processing in the present invention is desired to process the aluminum plate under such a condition that aluminum in a range of, preferably, from 2 to 12 g/m$^2$, is etched. When the aluminum plate subjected to brush graining, is etched in the above described range, a uniform micro-shape grained surface having a large average roughness which is the object of the present invention can be produced.

In case of carrying out chemical processing of the surface of the aluminum with an aqueous solution of alkali, insoluble residues, namely, smuts are formed on the surface.

The smut can be removed with phosphoric acid, nitric acid, chromic acid, or a mixture thereof.

In the present invention, it is preferred that the surface of the aluminum to be electrochemically processed is a cleansed face having no smut. However, desmutting can be omitted in case that the electrolytic solution is acidic and has a desmutting function.

Thus processed aluminum plate is then subjected to electrochemical graining as described above.

It is preferred to form an anodic oxidation film on the surface of the resulting aluminum support. When an electric current is applied to the aluminum base as an anode in an aqueous solution or a nonaqueous solution containing sulfuric acid, phosphoric acid, chromic acid, oxalic acid, sulfamic acid, benzenesulfonic acid, etc., or a combination of two or more of them, an anodic oxidation film can be formed on the surface of the aluminum support.

Processing conditions for the anodic oxidation varies according to the electrolytic solution to be used. However, it is preferred that the concentration of electrolyte in the electrolytic solution be in a range of from 1 to 80% by weight, the temperature is in a range of from 5° to 70° C., the current density is in a range of from 0.5 to 60 amperes/dm$^2$, the voltage is in a range of from 1 to 100 V, and the electrolytic time is in a range of from 30 seconds to 50 minutes. In greater detail, it is preferred to use anodic oxidation processing conditions shown in the following Table A.

TABLE A

| Electrolytic solution | Concentration of electrolytic solution (aqueous solution) (% by weight) | Liquid temperature (°C.) | Current density (A/dm$^2$) | Voltage (volt) | Electrolytic time (minute) |
|---|---|---|---|---|---|
| Sulfuric acid | 1-70 | 5-65 | 0.5-30 | 1-50 | 1-30 |
| Oxalic acid | 1-20 | 20-60 | 0.5-20 | 10-70 | 5-40 |
| Phosphoric acid | 2-60 | 20-60 | 0.5-20 | 10-60 | 1-30 |
| Chromic acid | 2-30 | 20-60 | 0.5-10 | 10-60 | 1-50 |

To the resulting support, a light-sensitive material is applied to obtain a light-sensitive planographic printing plate. As the light-sensitive material, any material can be used, if the solubility or swelling thereof in the developing solution suitably changes by exposure to light.

Preferred examples include light-sensitive compositions composed of a diazo compound, for example, diazo resin and shellac (Japanese Patent Application (OPI) No. 34404/72), light-sensitive compositions composed of poly-(hydroxyethylmethacrylate) and diazo resin, light-sensitive compositions composed of diazo resin and soluble polyamide resin (U.S. Pat. No. 3,751,257), light-sensitive compositions composed of azide light-sensitive substance and epoxy resin (U.S. Pat. No. 2,852,379), and light-sensitive compositions composed of light-sensitive resin having unsaturated double bonds in the molecule which causes a dimerization reaction by irradiation of active rays to become insoluble, such as polyvinylcinnamate, polyvinylcinnamate derivatives described, for example, in British Pat. Nos. 843,545 and 966,297, U.S. Pat. No. 2,725,372, etc., light-sensitive polyesters formed by condensation of bisphenol A and divanillalcyclohexanone or p-phenylenediethoxy acrylate and 1,4-di-$\beta$-hydroxyethoxycyclohexanone as described in Canadian Pat. No. 696,997, prepolymers of diallyl phthalate described in U.S. Pat. No. 3,462,267 and ethylenically unsaturated compounds having at least two unsaturated double bonds in the molecule which cause a polymerization reaction by irradiation of active rays, for example, unsaturated esters of polyols described in Japanese Patent Publication No. 8495/60 such as ethylene diacrylate (or dimethacrylate), diethyleneglycol diacrylate (or dimethacrylate), glycerine diacrylate (or dimethacrylate), glycerine triacrylate (or trimethacrylate), ethylene dimethacrylate, 1,3-propylene diacrylate (or dimethacrylate), 1,4-cyclohexanediol acrylate (or methacrylate), 1,4-benzenediol diacrylate (or dimethacrylate), pentaerythritol tetraacrylate (or tetramethacrylate), 1,3-propylene glycol diacrylate (or dimethacrylate), 1,5-pentaerythritol diacrylate (or dimethacrylate), pentaerythritol triacrylate (or trimethacrylate) or bisacrylate or methacrylate of polyethylene glycol having a molecular weight of from 50 to 500, unsaturated amides, particularly, $\alpha$-methylenecarboxylic acid amide and, particularly, $\alpha,\omega$-diamine derivatives and $\omega$-diamine derivatives having oxygen in the middle thereof, for example, methylene bisacrylamide (or methacrylamide) and diethylenetriamine triacrylamide (or trimethacrylamide), divinyl succinate, divinyl adipate, divinyl phthalate, divinyl terephthalate, divinylbenzene-1,3-disulfonate and the like, and suitable binders, for example, polyvinylalcohol or cellulose derivatives having a carboxyl group in the side chain, for example, polyvinyl hydrogen phthalate, carboxymethyl cellulose or copolymer of methyl methacrylate and methacrylic acid, etc., which become insoluble by action of active rays and are useful as negative working type light-sensitive compositions. Light-sensitive compositions composed of o-diazo oxide type light-sensitive substances described in U.S. Pat. Nos. 3,061,120, 3,061,430 and 3,635,709, phosphotungstates of diazo resins (Japanese Patent Publication No. 7663/64), ferrocyanides of diazo resins (U.S. Pat. No. 3,113,023) or disazo resin and polyvinyl hydrogen phthalate (Japanese Patent Publication No. 23684/68), etc. are useful as positive working type light-sensitive materials. Further, light-sensitive compositions containing linear polyamide and monomers having an addition-polymerizable unsaturated bond described in U.S. Pat. Nos. 3,081,168, 3,486,903, 3,512,971, 3,615,629, etc., are useful.

If desired, the aluminum plate may be subjected to surface processing with silicates prior to application of the light-sensitive material in order to increase a hydrophilic property of the surface thereof.

As preferred silicates, those described in U.S. Pat. No. 2,714,066 are suitably used.

In the following, the process for producing the support for planographic printing according to the present invention is illustrated in greater detail by reference to examples. All % values indicate % by weight.

EXAMPLE 1

Figure 3:
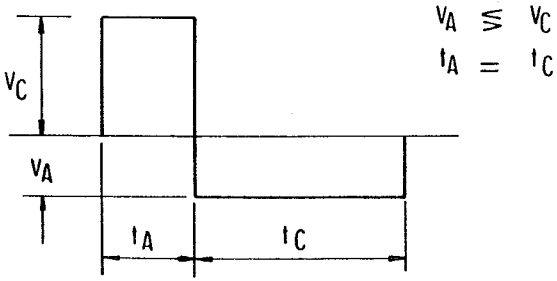
FIG. 3 is a voltage wave form view of an electric current obtained as an asymmetrical alternating wave form electric current.

An aluminum sheet having a purity of 99.5% was grained so as to have a surface roughness of Ra: 0.6 microns with a pumice-aqueous suspension by a revolving nylon brush roll, and it was then etched with a 20% aqueous solution of caustic soda so that the dissolution amount of the aluminum was 8 g/m$^2$. After sufficiently washing with flowing water, it was washed with a 25% aqueous solution of nitric acid, and then again washed with water to prepare a base plate. This base plate was subjected to electrolytic graining with an alternating wave form electric current having a rectangular wave form as shown in FIG. 3 under the conditions shown in Table 1. Subsequently, it was immersed in a 15% aqueous solution of sulfuric acid at 50° C. for 3 minutes to cleanse the surface, and it was then subjected to anodic oxidation in a 20% aqueous solution of sulfuric acid by a direct electric current to form an oxide film having 2.4 g/m$^2$, whereby samples A, B, C and D were produced. To the resulting samples, the following light-sensitive layer was applied, so that the coating amount after drying was 2.5 g/m$^2$.

| | |
|---|---|
| Ester compound obtained with naphthoquinone-1,2-diazido-5-sulfonyl chloride and pyrogallol-acetone resin (compound as described in U.S. Pat. No. 3,635,709 Example 1) | 0.75 g |
| Cresol novolak resin | 2.00 g |
| Oil Blue #603 (produced by Orient Chemical Co.) | 0.04 g |
| Ethylene dichloride | 16 g |
| 2-Methoxyethyl acetate | 12 g |

The resulting light-sensitive planographic printing plates were imagewise exposed by a 3 kW metal halide lamp at a distance of 1 m for 60 seconds and then developed with an aqueous solution of sodium silicate having a molar ratio $SiO_2/Na_2O$ of 1.2 and a $SiO_2$ content of 1.5%. When printing was carried out by the conventional procedure using the resulted planographic printing plates, the results shown in Table 2 were obtained. It is understood from these results that planographic printing plates produced using an electrolytic solution to which sulfuric acid is added according to the present invention have excellent performances in both printing durability and resistance to background contamination as compared with the case wherein no sulfuric acid was added and the case wherein sulfuric acid is added in an amount beyond the scope of the present invention.

TABLE 1

| Condition for electrolytic graining | Comparative example Sample A | Example Sample B | Example Sample C | Comparative example Sample D |
|---|---|---|---|---|
| Concentration of electrolytic solution | | | | |
| Nitric acid (ppm) | 7000 | 7000 | 7000 | 7000 |
| Sulfuric acid (ppm) | 0 | 100 | 1000 | 5000 |
| Aluminium nitrate (ppm) | 4000 | 4000 | 4000 | 4000 |
| Current density | | | | |
| Anode time current density (A/dm$^2$) | 35 | 35 | 35 | 35 |
| Cathode time current density (A/dm$^2$) | 28 | 28 | 28 | 28 |
| Quantity of electricity | | | | |
| Quantity of anode time electricity (coulomb/dm$^2$) | 175 | 175 | 175 | 175 |
| Quantity of cathode time electricity (coulomb/dm$^2$) | 140 | 140 | 140 | 140 |
| Cathode time/anode time | 0.8 | 0.8 | 0.8 | 0.8 |

TABLE 2

Figure 6A:
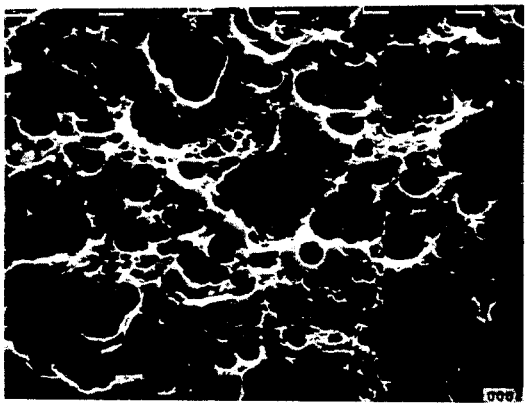
FIG. 6A, FIG. 6B, FIG. 6C and FIG. 6D are electron microphotographs of samples obtained by varying the amount of sulfuric acid.
Figure 6B:
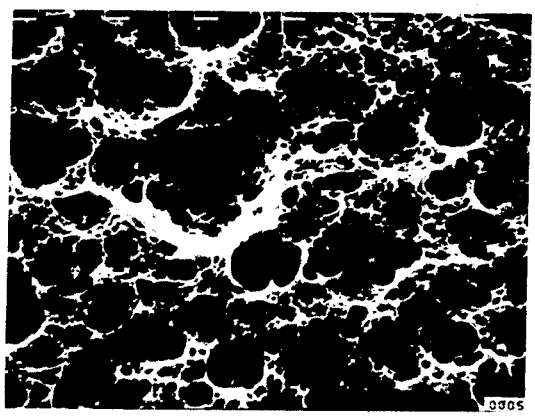
Figure 6C:
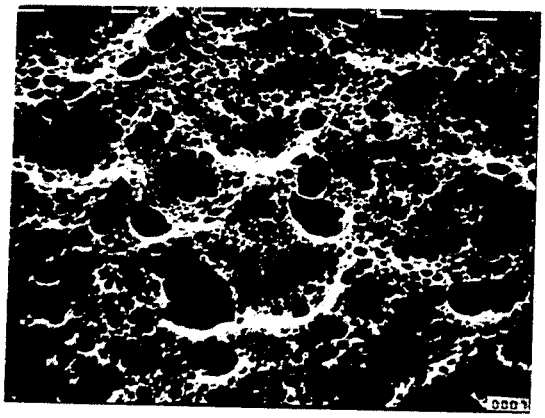
Figure 6D:
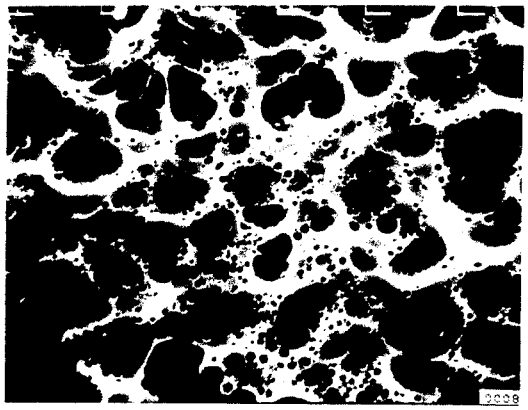

| | Comparative example Sample A | Example Sample B | Example Sample C | Comparative example Sample D |
|---|---|---|---|---|
| Character of support | | | | |
| Surface roughness (Ra) | 0.6 | 0.6 | 0.6 | 0.6 |
| Weight of oxide film (g/m$^2$) | 2.4 | 2.4 | 2.4 | 2.4 |
| Reflection density | 0.24 | 0.27 | 0.31 | 0.24 |
| Shape of surface | FIG. 6A | FIG. 6B | FIG. 6C | FIG. 6D |
| Printing performance | | | | |
| Printing durability (ten thousand) | 12 | 15 | 15 | 12 |
| Resistance to background contamination | Satisfactory | Excellent | Excellent | Satisfactory |

EXAMPLE 2

Figure 4:
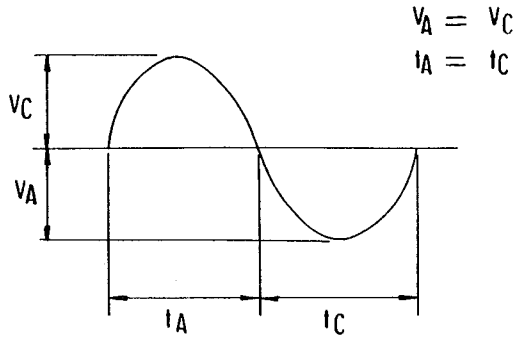
FIG. 4 is a voltage wave form view of an electric current obtained as a sinusoidal alternating wave-form electric current.
Figure 7A:
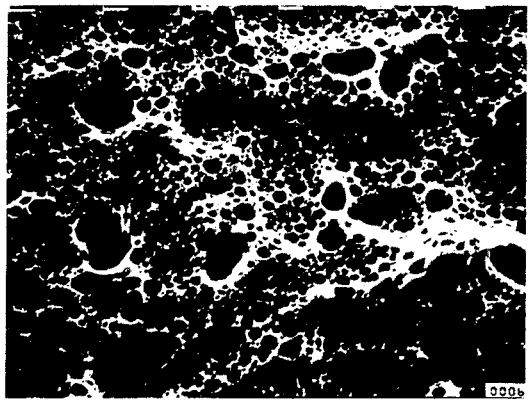
FIG. 7A, FIG. 7B and FIG. 8A are electron microphotographs of other samples obtained by changing various conditions for electrolytic graining.
Figure 7B:
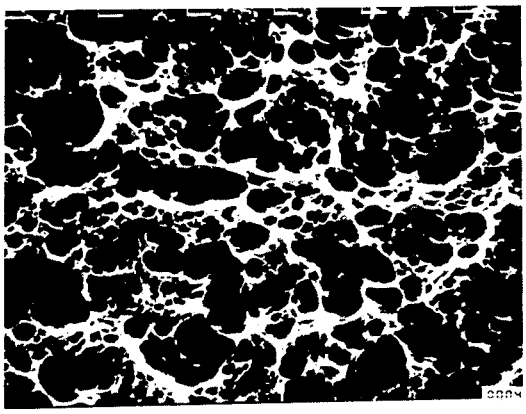

A JIS A1050 aluminum sheet was grained by running water jetting from a nozzle at a pressure of 50 kg/cm$^2$ with which a pumice-aqueous suspension having an average particle size of 100 microns was joined, against the surface of the aluminum sheet to form a grained surface having Ra 0.5 microns. The surface was etched with a 20% aqueous solution of caustic soda so that the etching amount was 5 g/m$^2$. After washing with water, it was washed with a 20% aqueous solution of nitric acid to prepare a cleansed base plate. This base plate was electrolytically grained with a rectangular alternating wave form electric current or a sinusoidal alternating wave form electric current as shown in FIG. 3 or FIG. 4 under conditions as shown in Table 3. After washing with water, it was immersed in a 15% aqueous solution of sulfuric acid at 50° C. to cleanse the surface. Thereafter, it was subjected to anodic oxidation in a 20% aqueous solution of sulfuric acid by a direct electric current to form an oxide film having 1.8 g/m$^2$. It was then immersed in a 1% aqueous solution of sodium silicate at 70° C. for 1 minute and washed with water and dried. Thus, samples E, F, G and H which were processed under different conditions for electrolytic graining were produced. SEMs of the grained surface of samples E and F are shown in FIG. 7A and FIG. 7B. To the resulting samples, a light-sensitive solution having the following composition was applied, so that the weight after drying was 2.0 g/m$^2$.

Light-sensitive solution:

| | |
|---|---|
| N—(4-hydroxyphenyl)methacrylamide/2-hydroxyethyl methacrylate/acrylonitrile/methyl methacrylate/methacrylic acid (molar ratio = 15:10:30:38:7) copolymer (average molecular weight: 60,000) | 5.0 g |
| Hexafluorophosphate of 4-diazodiphenylamineformaldehyde condensation product | 0.5 g |
| Phosphorous acid | 0.05 g |
| Victoria Pure Blue BOH (produced by Hodogaya Chemical Co.) | 0.1 g |
| 2-Methoxyethanol | 100 g |

After the resulting light-sensitive planographic printing plates were exposed by a Fuji Film PS light (which had a 3 kW Toshiba metal halide lamp: MU2000-2-DL type light source and sold by Fuji Photo Film Co.) at a distance of 1 m for 50 seconds through a transparent negative film in a vacuum printing frame, they were developed with a developing solution having the following composition and gummed with an aqueous solution of gum arabic to produce planographic printing plates.

Developing solution:

| | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1000 g |

When printing was carried out according to the conventional procedure using the resulting planographic printing plates, the results shown in Table 4 were obtained.

It is understood from these results that planographic printing plates produced using an electrolytic solution to which sulfuric acid is added according to the present invention have excellent performance in both printing durability and resistance to background contamination as compared with cases of using an electrolytic solution which is beyond the scope of the present invention, and that, particularly, excellent printing performance is obtained in the case of using a rectangular alternating wave form electric current.

TABLE 3

| Condition for electrolytic graining | Example Sample E | Comparative example Sample F | Example Sample G | Comparative example Sample H |
|---|---|---|---|---|
| Concentration of electrolytic solution | | | | |
| Nitric acid (ppm) | 7000 | 7000 | 7000 | 7000 |
| Sulfuric acid (ppm) | 500 | 10 | 500 | 10 |
| Aluminium nitrate (ppm) | 4000 | 4000 | 4000 | 4000 |
| Wave form of electric current | Rectangular wave | Rectangular wave | Sinusoidal wave | Sinusoidal wave |
| Current density | | | | |
| Anode time current density (A/dm$^2$) | 35 | 35 | 35 | 35 |
| Cathode time current density (A/dm$^2$) | 28 | 28 | 28 | 28 |
| Quantity of electricity | | | | |
| Quantity of anode time electricity (coulomb/dm$^2$) | 175 | 175 | 175 | 175 |
| Quantity of cathode time electricity (coulomb/dm$^2$) | 140 | 140 | 140 | 140 |
| Cathode time/anode time | 0.8 | 0.8 | 0.8 | 0.8 |

TABLE 4

| | Example Sample E | Comparative example Sample F | Example Sample G | Comparative example Sample H |
|---|---|---|---|---|
| Character of support | | | | |
| Surface roughness (Ra) | 0.5 | 0.5 | 0.5 | 0.5 |
| Weight of oxide film (g/m$^2$) | 1.8 | 1.8 | 1.8 | 1.8 |
| Reflection density | 0.29 | 0.23 | 0.27 | 0.23 |
| Shape of surface | FIG. 7A | FIG. 7B | | |
| Printing performance | | | | |

TABLE 4-continued

| | Example Sample E | Comparative example Sample F | Example Sample G | Comparative example Sample H |
|---|---|---|---|---|
| Printing durability (ten thousand) | 12 | 10 | 11 | 10 |
| Resistance to background contamination | Excellent | Satisfactory | Satisfactory | Satisfactory |

EXAMPLE 3

An aluminum sheet having a purity of 99.5% which was subjected to preliminary processing as described in Example 1 with adding 10 ppm or 500 ppm of sulfuric acid under an electrolytic condition corresponding to the point: A in FIG. 1 was electrolytically grained with a rectangular alternating wave form electric current under conditions shown in Table 5. Subsequently, it was immersed in a 15% aqueous solution of sulfuric acid at 50° C. for 3 minutes to cleanse the surface. Thereafter, it was subjected to anodic oxidation in a 20% aqueous solution of sulfuric acid by direct electric current to form an oxide film having 1.8 g/m$^2$. Thus, samples I and J were obtained. To the resulting samples, a light-sensitive layer was applied as described in Example 1, and exposure and development were carried out. When printing was carried out according to the conventional procedure using the resulting planographic printing plates, the results shown in Table 6 were obtained.

It is understood from these results that the planographic printing plate produced using an electrolytic solution to which sulfuric acid is added according to the present invention has excellent performance in both printing durability and resistance to background contamination as compared with the case of using an electrolytic solution which is beyond the scope of the present invention.

TABLE 5

| Condition for electrolytic graining | Comparative example Sample I | Example Sample J |
|---|---|---|
| Concentration of electrolytic solution | | |
| Nitric acid (ppm) | 7000 | 7000 |
| Sulfuric acid (ppm) | 10 | 500 |
| Aluminum nitrate (ppm) | 4000 | 4000 |
| Wave form of electric current | Rectangular wave | Rectangular wave |
| Current density | | |
| Anode time current density (A/dm$^2$) | 20 | 20 |
| Cathode time current density (A/dm$^2$) | 16 | 16 |
| Quantity of electricity | | |
| Quantity of anode time electricity (coulomb/dm$^2$) | 90 | 90 |
| Quantity of cathode time electricity (coulomb/dm$^2$) | 72 | 72 |
| Cathode time/anode time | 0.8 | 0.8 |

TABLE 6

Figure 8A:
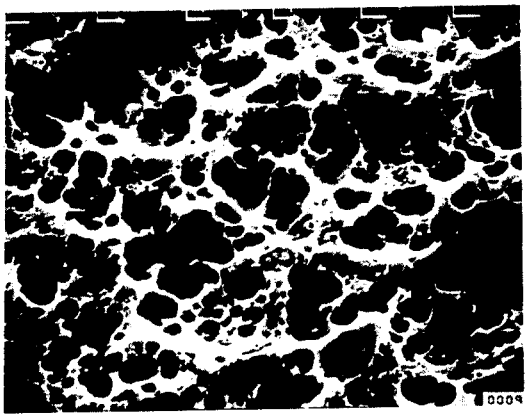

| | Comparative example Sample I | Example Sample J |
|---|---|---|
| Character of support | | |
| Surface roughness (Ra) | 0.5 | 0.5 |
| Weight of oxide film (g/m$^2$) | 1.4 | 1.4 |
| Reflection density | 0.19 | 0.20 |
| Shape of surface | FIG. 5A | FIG. 8A |

TABLE 6-continued

| | Comparative example Sample I | Example Sample J |
|---|---|---|
| Printing performance | | |
| Printing durability (ten thousand) | 6 | 8 |
| Resistance to background contamination | unsatisfactory | satisfactory |

While the invention has been described in detail and with reference to specific embodiments thereof, it will be apparent to one skilled in the art that various changes and modifications can be made therein without departing from the spirit and scope thereof.

What is claimed is:

1. A process for producing a support for planographic printing which comprises electrochemically graining the surface of an aluminum plate with an electrolytic solution consisting essentially of from 1,000 to 40,000 ppm of nitric acid and from 50 to 4,000 ppm of sulfate ion, wherein electrolytic graining is carried out with an asymmetrical alternating wave form electric current so that the ratio of the quantity of cathode time electricity to the quantity of anode time electricity is in a range of from 0.4/1 to 1.25/1.

2. A process for producing a support for planographic printing which comprises electrochemically graining the surface of an aluminum plate with an electrolytic solution consisting essentially of from 1,000 to 40,000 ppm of nitric acid and from 50 to 4,000 ppm of sulfate ion, and thereafter carrying out anodic oxidation, wherein electrolytic graining is carried out with an asymmetrical alternating wave form electric current so that the ratio of the quantity of cathode time electricity to the quantity of anode time electricity is in a range of from 0.4/1 to 1.25/1.

3. A process for producing a support for planographic printing which comprises mechanically graining the surface of an aluminum plate, chemically etching in such a range that the dissolution amount of aluminum is from 2 to 12 g/m$^2$, and electrochemically graining with an electrolytic solution consisting essentially of from 1,000 to 40,000 ppm of nitric acid and from 50 to 4,000 ppm of sulfate ion, wherein electrolytic graining is carried out with an asymmetrical alternating wave form electric current so that the ratio of quantity of cathode time electricity to the quantity of anode time electricity is in a range of from 0.4/1 to 1.25/1.

4. A process for producing a support for planographic printing which comprises mechanically graining the surface of an aluminum plate, chemically etching in such a range that the dissolution amount of aluminum is from 2 to 12 g/m$^2$, and electrochemically graining with an electrolytic solution consisting essentially of from 1,000 to 40,000 ppm of nitric acid, and from 50 to 4,000 ppm of sulfate ion, and thereafter carrying out anodic oxidation, wherein electrolytic graining is carried out with an asymmetrical alternating wave form electric current so that the ratio of the quantity of cathode time electricity to the quantity of anode time electricity is in a range of from 0.4/1 to 1.25/1.

5. A process for producing a support for planographic printing according to claim 2, wherein the anodic oxidation is carried out under the conditions that the concentration of electrolyte in the electrolytic solution is in a range of from 1 to 80% by weight, the temperature is in a range of from 5° to 70° C., the current density is in a range of from 0.5 to 60 A/dm$^2$, the voltage is in a range of from 1 to 100 V, and the electrolytic time is in a range of from 30 seconds to 50 minutes.

6. A process for producing a support for planographic printing according to claim 4, wherein the anodic oxidation is carried out under the conditions that the concentration of electrolyte in the electrolytic solution is in a range of from 1 to 80% by weight, the temperature is in a range of from 5° to 70° C., the current density is in a range of from 0.5 to 60 A/dm$^2$, the voltage is in a range of from 1 to 100 V, and the electrolytic time is in a range of from 30 seconds to 50 minutes.

7. A planographic printing support produced by the process of claim 1.

8. A planographic printing support produced by the process of claim 3.

9. A process for producing a support for planographic printing which comprises electrochemically graining the surface of an aluminum plate with an electrolytic solution consisting of from 1,000 to 40,000 ppm of nitric acid, from 50 to 4,000 ppm of sulfate ion and from 1,000 to 20,000 ppm of aluminum nitrate.

10. A process for producing a support for planographic printing which comprises mechanically graining the surface of an aluminum plate, chemically etching in such a range that the etching amount of aluminum is from 2 to 12 g/m$^2$, electrochemically graining with an electrolytic solution consisting of from 5,000 to 30,000 ppm of nitric acid, from 50 to 4,000 ppm of sulfate ion and from 1,000 to 20,000 ppm of aluminum nitrate, and thereafter carrying out anodic oxidation of the aluminum plate.

11. A process for producing a support for planographic printing according to claim 10, wherein the anodic oxidation is carried out under the conditions that the concentration of electrolyte in the electrolytic solution is in a range of from 1 to 80% by weight, the temperature is in a range of from 5° to 70° C., the current density is in a range of from 0.5 to 60 A/dm$^2$, the voltage is in a range of from 1 to 100 V, and the electrolytic time is in the range of from 30 seconds to 50 minutes.

* * * * *